US005368262A

United States Patent [19]

Garrity

[11] Patent Number: 5,368,262

[45] Date of Patent: Nov. 29, 1994

[54] ADJUSTABLE MOUNTING SUPPORT FOR A BOX FAN

[76] Inventor: Frank J. Garrity, 864 Wyndom Ter., Secane, Pa. 19018

[21] Appl. No.: 935,241

[22] Filed: Aug. 27, 1992

[51] Int. Cl.[5] ..... A47F 5/02

[52] U.S. Cl. ..... 248/131; 248/299; 248/208; 211/162

[58] Field of Search ..... 248/131, 144, 208, 209, 248/299, 236; 211/94, 94.5, 162; 108/68

[56] References Cited

U.S. PATENT DOCUMENTS

| | | | |
|---|---|---|---|
| 477,355 | 6/1892 | Curtis et al. | 248/208 |
| 619,752 | 2/1898 | Hudson | 248/208 |
| 866,463 | 9/1907 | Hart | 248/208 |
| 950,006 | 2/1910 | McCarty | 211/162 |
| 1,324,713 | 12/1919 | Adsit | 248/208 |
| 1,522,079 | 1/1925 | Read | 248/299 |
| 1,589,198 | 6/1926 | McComb | 211/150 |
| 2,677,522 | 5/1954 | Johnson | 248/208 |
| 2,857,095 | 10/1958 | Suarez Grau | 248/236 |
| 2,889,764 | 6/1959 | McGrath et al. | 248/208 |
| 2,933,273 | 4/1960 | Koch | 248/122 |
| 3,071,288 | 1/1963 | Gantner | 248/311.2 X |
| 3,245,716 | 4/1966 | Danner | 248/299 |
| 3,254,891 | 6/1966 | Brown | 211/162 X |
| 3,452,878 | 7/1969 | Smith | 211/162 X |
| 4,738,423 | 4/1988 | DiFilippo et al. | 248/311.2 |
| 4,846,354 | 7/1989 | Adams | 211/94 X |
| 4,978,096 | 12/1990 | Struckmann | 248/461 X |
| 5,050,831 | 9/1991 | Joyal | 248/354.5 |

*Primary Examiner*—Alvin C. Chin-Shue
*Assistant Examiner*—Korie H. Chan
*Attorney, Agent, or Firm*—Eric A. LaMorte

[57] ABSTRACT

The present invention is a mounting support for mounting a free-standing box fan on a narrow window sill in a manner that allows the box fan to be selectively adjusted, relative the window, into differing directions without interfering with the operation of the window or comprising the support for the box fan on the window sill.

15 Claims, 6 Drawing Sheets

ADJUSTABLE MOUNTING SUPPORT FOR A BOX FAN

BACKGROUND OF THE INVENTION

1. Field of the Invention

The present invention relates to a structure for mounting a free-standing box fan on a narrow window sill and more particularly to such mounting structures that allow the box fan to be turned into a desired direction, relative an adjacent open window, while maintaining full contact with the window sill and without causing the box fan to interfere with the adjacent window structure.

2. Prior Art Description

Box fans are perhaps the most common type of portable fans sold today. Box fans derive their names from their shape; that is a box fan is conventionally box shaped having a flat face and rear surface supported by a square shaped peripheral housing. Because of the square shape of conventional box fans, the fans tend to be easy to manipulate and free standing on any flat surface. Such box fans are commonly commercially available and the prior art is replete with patents that describe various styles and types of box fans.

As will be recognized by most any person, it is often desirable to place a fan in an open window to promote circulation between a structure, such as a house, and the outdoors. By placing a fan in an open window, fresh air can be drawn into the house from the outdoors or air can be drawn out of the house into the outdoors. However, it is not always easy to place a conventional box fan into an open window. Many times the window sill below an open window is narrow. This does not leave much room upon which a box fan can be placed. As such, box fans are often vicariously positioned on narrow window sills where they are not fully supported and may fall. Similarly, even if a window sill is wide enough to fully support a box fan, the box fan cannot be directed as desired. If the box fan is turned in any given direction, the base of the box fan leaves the window sill and the support for the fan is compromised. Consequently, when box fans are mounted in front of open windows, the range of movement allowed in orienting the box fan is determined by the width of the below lying window sill and the contact between the base of the box fan and the window sill.

Another limiting factor in the positioning of a box fan on a window sill is the presence of a screen in the open window. A window screen is often positioned immediately adjacent the window sill. As such, a box fan is prevented from being positioned in any orientation that would cause the box fan to extent beyond the window screen. In addition to the limitations caused by the positioning of the box fan on a narrow window sill, the placement of a box fan in many windows is limited by the height to which the window can be opened. If a window cannot be opened wide enough to accommodate the height of the box fan, the box fan cannot be positioned flush against the window sill below the open window. Consequently, the box fan must be tilted at an angle on the window sill, thereby reducing the support the window sill provides the box fan. If the box fan cannot be adequately supported by the confines of the window sill and the height of the open window, the box fan cannot be placed on the window sill itself and therefore must be placed on a secondary support such as a table or a chair in front of the open window.

The prior art is replete with many devices that can be used to hold a fan in front of an open window. For example in U.S. Pat. No. 619,752 to Hudson and U.S. Pat. No. 866,463 to Hart, there are shown two types of pivotable shelves that can be affixed to a window frame. Such shelves can be adapted to retain fans in front of a window, however both shelves are affixed to the window and pivot in only a single direction, thereby limiting both patents adaptability to fans.

In U.S. Pat. No. 1,324,713 to Adsit there is shown a bracket construction for an electric fan whereby the fan is supported on the outside of the window. The supporting bracket is permanently affixed to the structure of the window, thereby making the support bracket non-adjustable. Furthermore, by positioning the fan outside the window, any window screen would have to be removed to access the fan through the window and the fan could not be used during inclement weather.

In U.S. Pat. Nos. 2,677,522 to Johnson and 2,857,095 to Suarez Gran both show fans that are constructed with brackets thereby allowing the fans to be mounted onto a window sill or frame. However in both devices the fans are unistructurally formed with their brackets and cannot be separated from their mounting brackets.

Lastly, in U.S. Pat. No. 5,050,831 to Joyal shows a portable bracket assembly for retaining a box fan in front of an open window that is incapable of supporting the box fan on its sill. In the Joyal patent, however, the box fan cannot be pivotally positioned into a desired direction, thereby limiting the effectiveness of positioning the box fan in front of an open window.

In view of the prior art there remains a need for a support bracket capable of mounting a box fan in front of an open window, whereby the box fan need not depend upon the size of the window sill for support and the box fan can be adjusted into any desired direction while positioned in front of an open window.

It is a further objective of the present invention to provide an inexpensive support mounting that can be retroactively installed, thereby allowing people with box fans to mount those fans as desired on the sill of a window.

SUMMARY OF THE INVENTION

The present invention is a mounting support that enables a free-standing box fan to be safely positioned on a narrow window sill in front of an open window. In a preferred embodiment, the present invention mounting support includes a narrow flat base member which can lay flush against the narrow window sill. An attachment means such as mechanical fasteners, clamps or the like secure the base member to the window sill. The base member supports a receptacle means shaped to receive and retain at least one portion of the box fan in front of the window. The receptacle means engages the bottom of the box fan's frame at opposing corners so as to not disrupt the flow of air through the fan. The receptacle means for holding the fan can be adjustable in size, thereby allowing the receptacle means to be specifically adjusted to properly and safely retain box fans of varying sizes. Additionally, the receptacle means may engage the box fan with a spring bias, thereby engaging the box fan in a positive manner and ensuring that the box fan is properly retained within the receptacle means.

The receptacle means is attached to the base member in a manner that allows the receptacle to be moved relative the base member and in a manner that prevents the box fan from extending beyond the operational plane of the window. To avoid intersecting the operational plane of the window, the receptacle means can be extended away from the window to a point the limits of the window sill. By extending the receptacle beyond the window sill, room is provided to rotate the box fan in front of the window without contacting the window or a screen that may be present across the window. In the preferred embodiment the receptacle means is joined to the base member by the presence of track members that ride within slots formed on the base member. By moving the track members in and out of the formed slots, the receptacle means can be directed into most any desired direction. Consequently, the box fan can be directed as desired in front of the window.

BRIEF DESCRIPTION OF THE DRAWINGS

For a better understanding of the present invention mounting support, reference is made to the following description of exemplary embodiments thereof, considered in conjunction with the accompanying drawings, in which.

Figure 2:
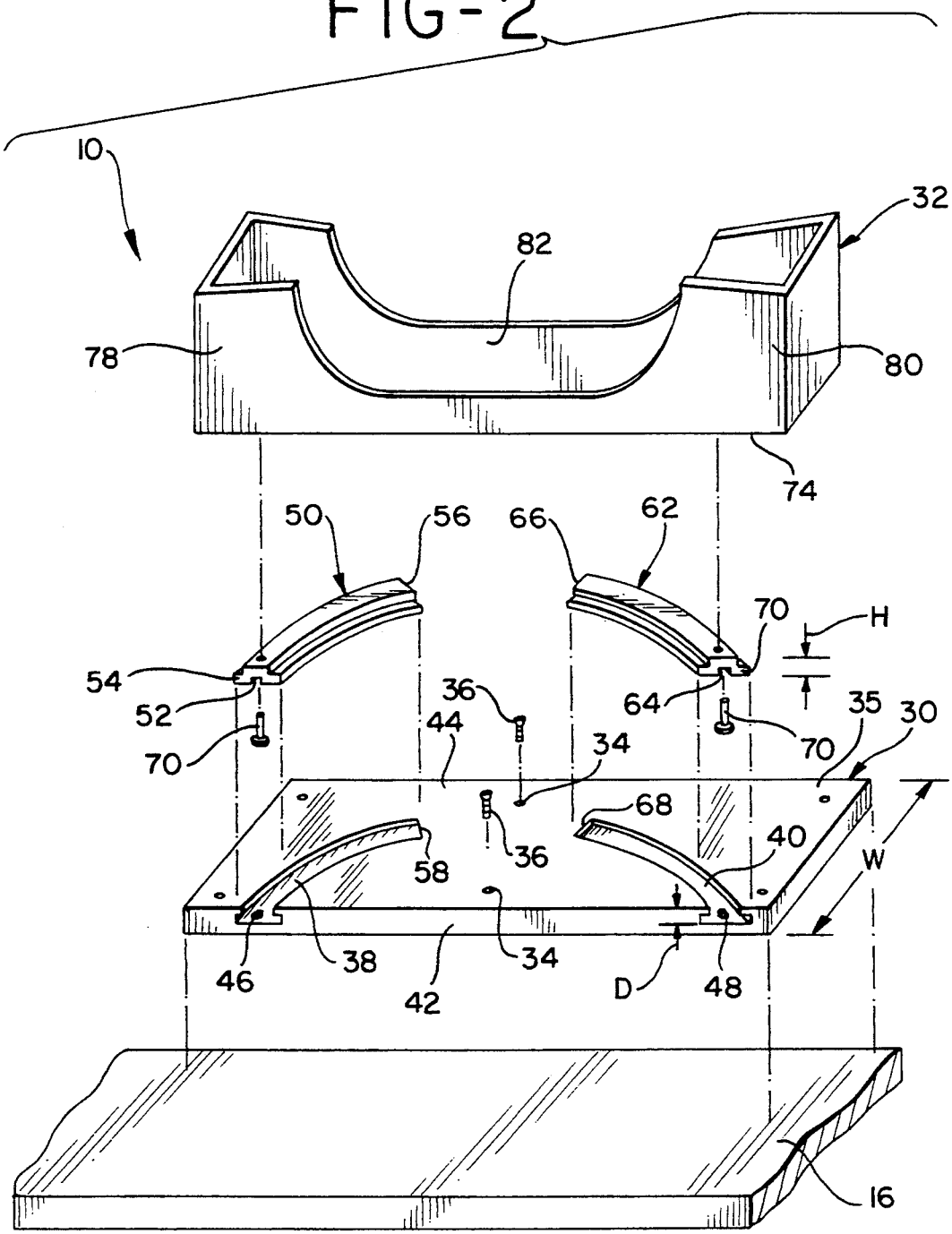
FIG. 2 is an exploded perspective view of the embodiment of the present invention shown in FIG. 1 and shown in conjunction with a window sill to facilitate the description of the present invention's operation.
Figure 4:
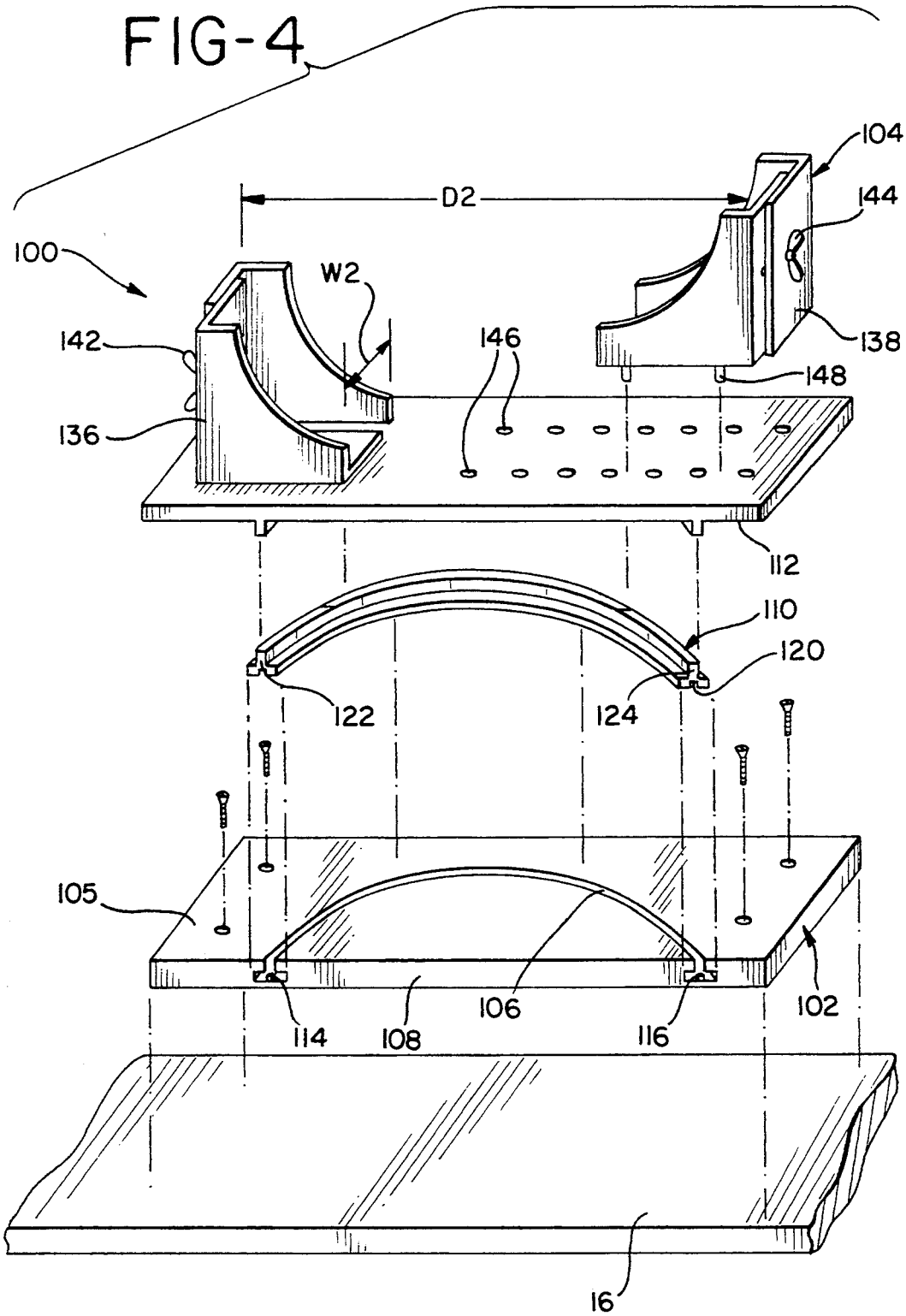

FIGS. *3a, 3b* and *3c* are top views of the embodiment of the present invention illustrated in FIG. 2, shown in conjunction with a box fan at three different positional orientations, respectively;

FIG. 4 is an exploded perspective view of an alternative embodiment of the present invention, shown in conjunction with a window sill to facilitate consideration and discussion; and FIGS. *5a* and *5b* are top views of the alternative embodiment Of the present invention illustrated in FIG. 4, shown in conjunction with a convention box fan at two differing positional orientations, respectively.

DETAILED DESCRIPTION OF THE DRAWINGS

Figure 1:
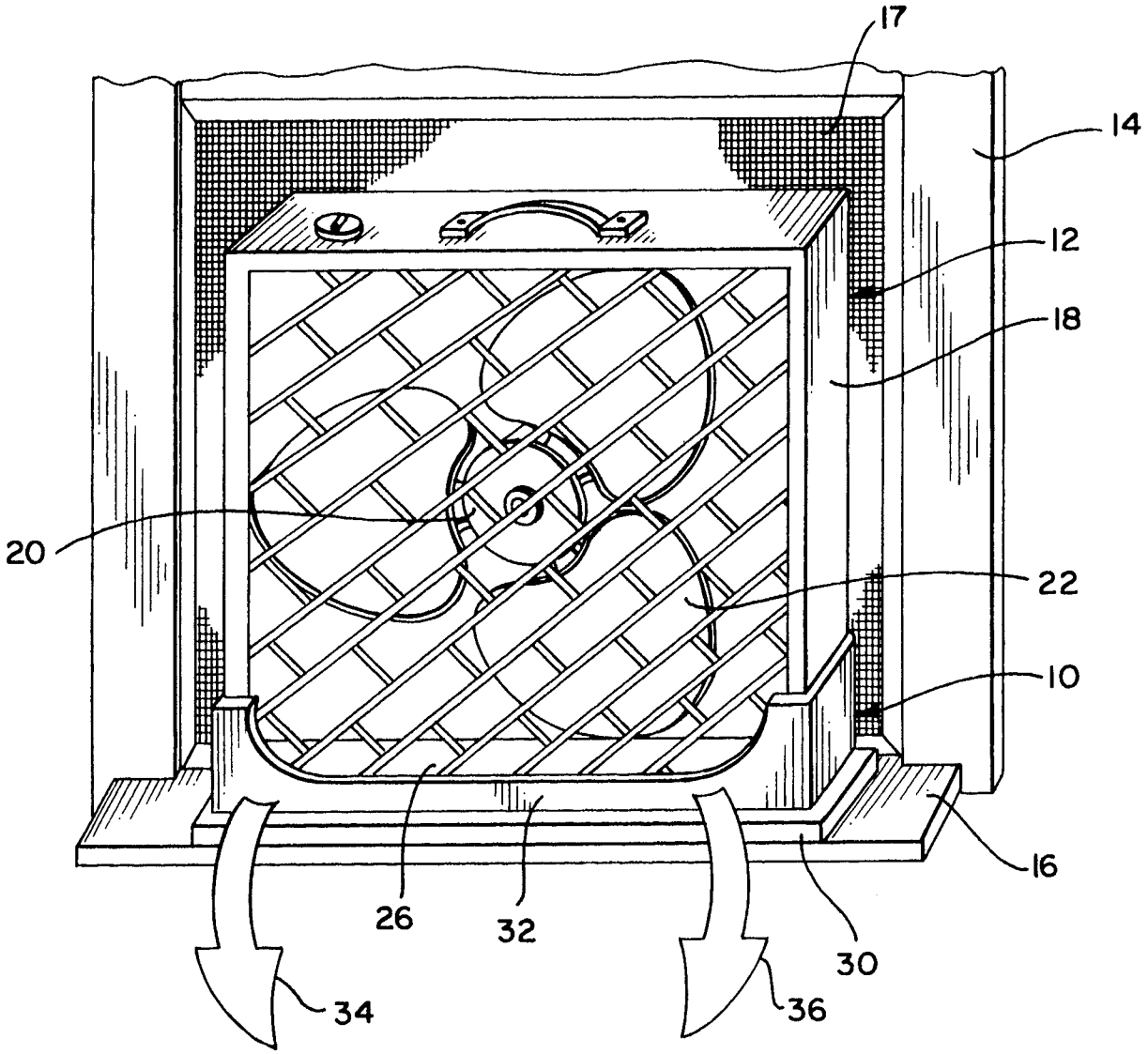
FIG. 1 is a front view of one preferred embodiment of the present invention mounting support, shown in conjunction with a conventional box fan and an open window structure to facilitate consideration and discussion.

Referring to FIG. 1 there is shown one preferred embodiment of the present invention fan mounting support 10 being used to support a conventional box fan 12 in front of an open window 14. The open window 14 is conventional in form having a narrow window sill 16 which protrudes horizontally at the base of the window 14. The window 14 also includes a screen 17 of the type typically associated with windows used in homes.

The box fan 12 shown is of a typical construction having a substantially square shaped peripheral housing 18 which supports an electric motor 20 and fan blades 22 at a central point. Protective grids 24 are positioned across the front and rear surfaces of the box fan 12 preventing accidental contact with the fan blades 22. Although the box fan 12 just described is the conventional construction for a box fan, it should be understood that any other fan having the same general exterior shape of a conventional box fan may also be used and should be considered a box fan for the purposes of this specification.

From FIG. 1, it can be seen that the base surface 26 of the box fan 12 is positioned within the present invention fan mounting support 10. As will be later described in detail, the mounting support 10 engages the housing 18 of the box fan 12, thereby retaining the box fan 12 into a set position. The mounting support 10 has two primary components, a base member 30 and a receptacle member 32. The base member 30 lays flush against the window sill 16 where it is affixed to the window sill 16 in a manner to be later explained. The receptacle member 32 of the mounting support 10 is the component that receives at least one portion of the box fan housing 18 thereby retaining the box fan 12 into a set position. The receptacle member 32 is affixed to the base member 30, yet is adjustably positionable relative the base member 30. The operation of the adjustable interconnection between the receptacle member 32 and the base member 30 will later be described in detail. The adjustable interconnection between the receptacle member 32 and the base member 30 allows the receptacle member 32 to move in either the direction of arrow 34, arrow 36 or both. As such, the movement of the receptacle member 32 upon the base member 30 allows the box fan 12 to be selectively positioned in a desired direction in front of the window 14. Furthermore, the positioning of the box fan 12 in a desired position can be accomplished without the support between the window sill 16 and the base member 30 being compromised and without the box fan 12 contacting the screen 17 stretched across the open window 14.

Referring to FIG. 2 there is shown an exploded view of a first preferred embodiment of the present invention mounting support 10. Beginning with the base member 30, it can be seen that base member 30 is substantially planar so as to lay flush against the flat surface of the window sill 16. As such the width W of the base member 30 is preferably equivalent or smaller than the width of the window sill 16 to ensure the base member 30 is capable of being positioned on the window sill 16. The base member 30 can be affixed to the window sill 16 in any known manner. In the shown embodiment, apertures 34 are formed through the material of the base member 30 thereby allowing the base member 30 to be affixed to the window sill 16 with mechanical fasteners 36. It should be recognized that many window sills 16 are vinyl coated or otherwise formed so that it would be undesirable to drive a mechanical fastener 36 into its structure. As such, it should be understood that any known clamping means (not shown) that joins the base member 30 to the window sill 16 nondestructively, such as that described in U.S. Pat. No. 2,677,522 to Johnson, may be used in place and stead of mechanical fasteners 36.

On the top surface 35 of the base member 30 opposite the surface that contacts the window sill 17 are formed two arcuate slots 38, 40. The arcuate slots 38, 40 extend from the front edge 42 of the base member 30 back toward the rear edge 44 of the base member 30. Locking tabs 46, 48 extend up centrally from the arcuate slots 38, 40 respectively, at points proximate the front edge 42 of the box member 30.

A first track member 50 is shaped and formed to fit within the first arcuate slot 38. The first track member 50 has a groove 52 formed down its center, traversing the first track member 50 from its proximal end 54 toward its distal end 56. The groove 52 is centrally formed along the first track member 50 but does not traverse the full length of the first track member 50. Rather, the groove 52 extends from the proximal end 54 of the first track member 50 and terminates at a point just before the distal end 56 of the first track member 50. As such, it should be understood that as the first track member 50 is positioned within the first arcuate slot 38, the locking tab 46 extending from the first arcuate slot 38 extends into the groove 52 of the first track member 50. Consequently, the first track member 50 is free to move reciprocally within the first arcuate slot 38 within a predetermined range of travel. The range of travel is thereby defined by the contact of the locking tab 48 with the end of the groove 52, as the first track member 50 is advanced beyond the front edge 42 of the base member 30, and the contact of the distal end 56 of the first track member 50 against the back edge 58 of the first arcuate slot 38 as the first track member 50 is advanced into the base member 30.

Similarly, it should be understood that the second track member 62 is shaped and sized to fit within the second arcuate slot 40. The locking tab 48 extending from the second arcuate slot 40 extends into the groove 64 formed on the second track member 62. The range of reciprocal travel permitted the second track member 62 in the second arcuate slot is governed by the contact of the locking tab 48 with the end of the groove 64 and the contact of the distal end 66 of the second track member 62 against the back edge 68 of the second arcuate slot 40.

The height H of the first and second track members 50, 62 are equivalent to the depth D of the first and second arcuate slots 38, 40. Consequently, when the first and second track members 50, 62 are positioned within the first and second arcuate slots 38,40 the top surface of the first and second track members 50, 62 lay in the same place as the top surface 35 of the base member 30.

The proximal end 54 of the first track member 50 and the proximal end 72 of the second track member 62 are pivotally affixed to the bottom surface 74 of the receptacle member 32. The attachment of the first and second track members 50, 62 to the bottom surface 74 of the receptacle member 32 can be accomplished in any known manner, but is preferably accomplished through use of a mechanical fastener 76, such as a rivet 70 which allows for the pivotable movement of the first and second track members 50, 62 about their points of attachment.

The receptacle member 32 is comprised of two vertical sections 78, 80 connected by a horizontal base section 82. The two vertical sections 78, 80 and the horizontal base section 82 define a channel that can be sized to retain the frame of a given box fan. The manner by which the receptacle member 32 retains the frame of a box fan will be later explained.

Figure 3A:
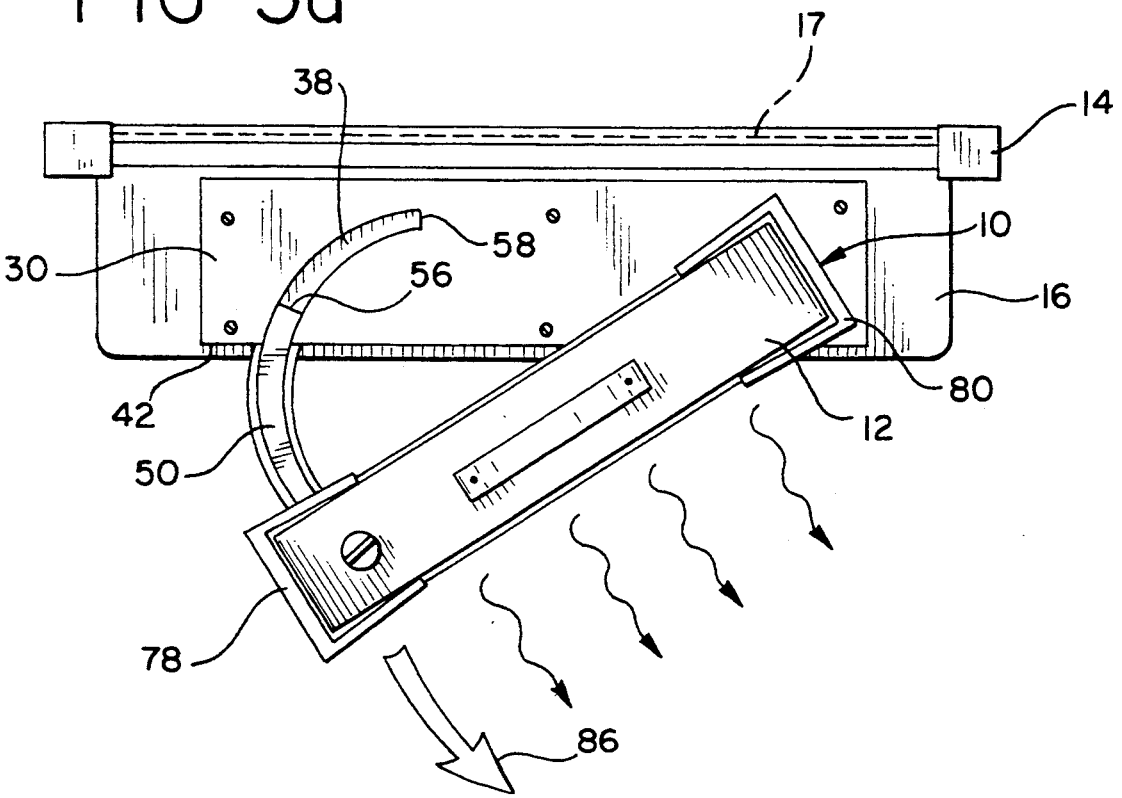
Figure 3B:
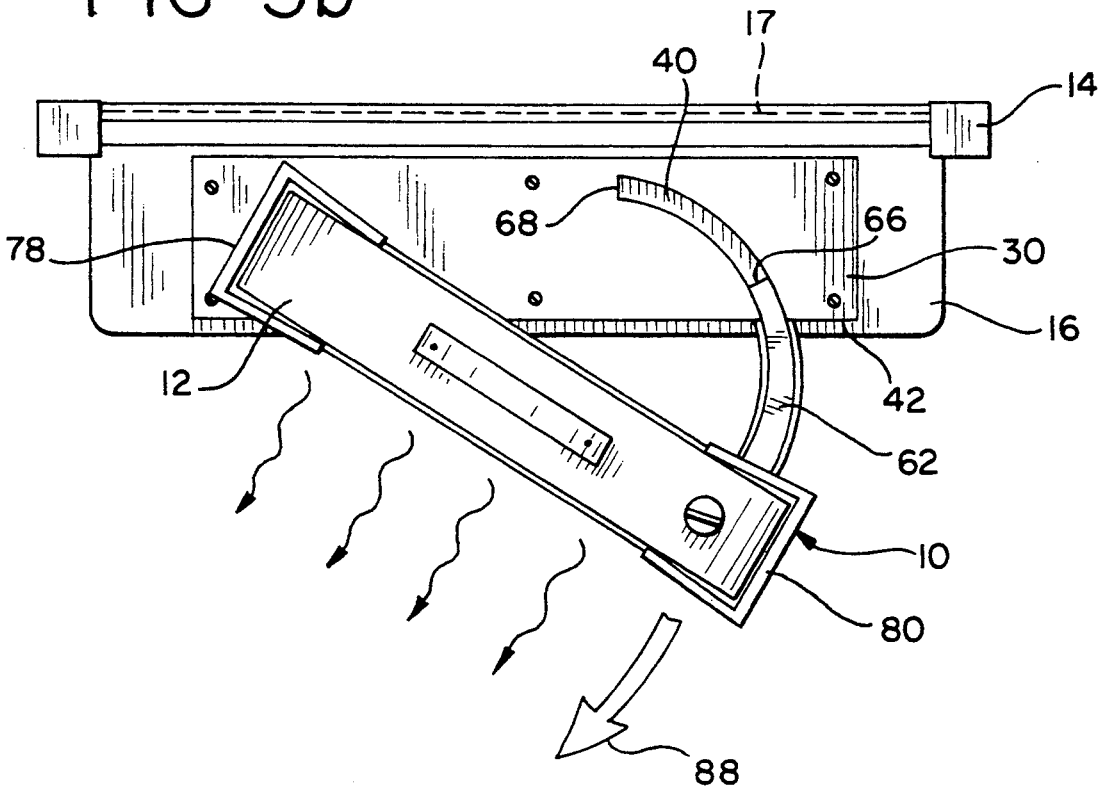
Figure 3C:
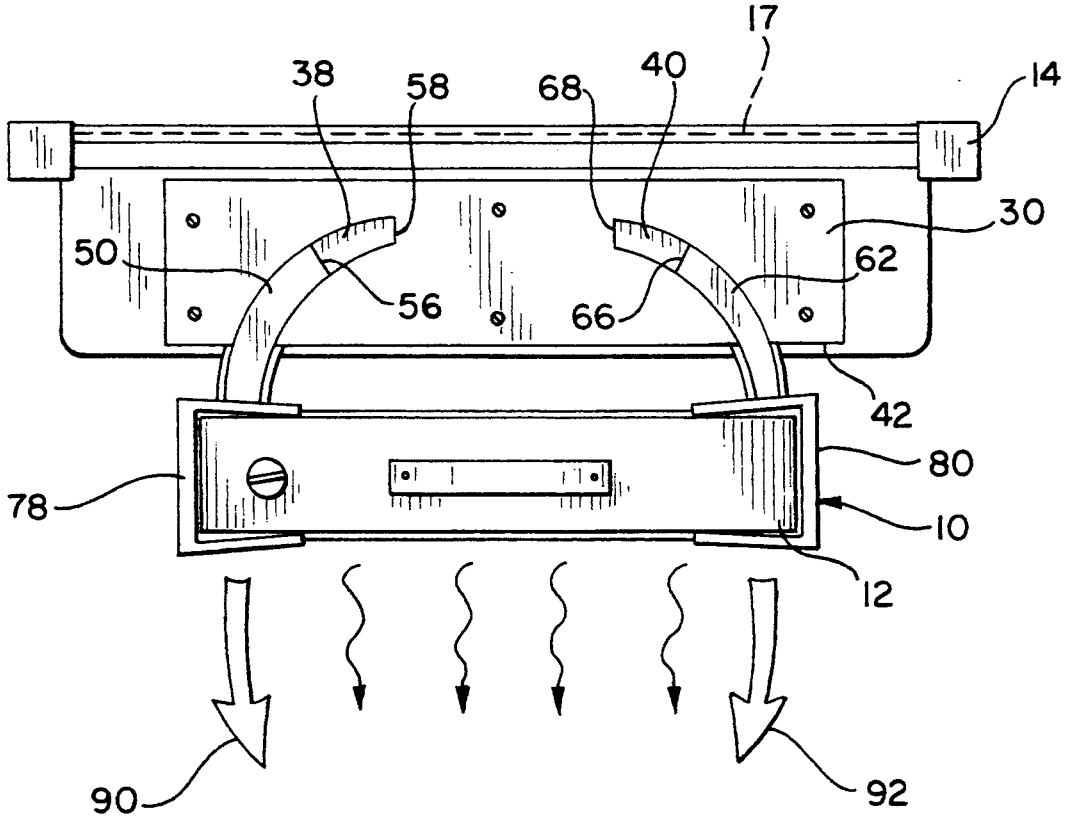

Referring now to FIGS. 3*a*, 3*b* and 3*c* in conjunction with FIG. 2, the pivoting function between the receptacle member 32 and the base member 30 of the present invention mounting support 10 can be shown. In FIGS. 3*a*–3*c* the present invention support member 10 is shown from above, as it would appear holding a box fan 12 in front of an open window 14. As can be seen in FIGS. 3*a*–3*c* the base member 30 of the mounting support 10 is affixed to a window sill 16 in front of an open window 14 that includes a screen 17. In FIG. 3*a* the present invention mounting support 10 is shown directing the box fan 12 to the right. To accomplish such an adjustment, the box fan 12 and/or the receptacle member 32 of the mounting support 10 is manipulated in the direction of the arrow 86. Such a manipulation causes the first track member 50 to move within the first arcuate slot 38 and extend beyond the front edge 42 of the base member 30. The manipulation indicated by arrow 86 leaves the second track member 62 relatively undisturbed within the second arcuate slot 40. Rather the receptacle member 32 merely pivots about its connection with the second track member 62 to compensate for the movement of the first track member 50.

As can be seen, the movement of the first track member 50 in the first arcuate slot 38 allows the box fan 12 to be directed to the right without disturbing the connection of the base member 30 against the window sill 16 and without having the box fan's movement hindered by the presence of the window screen 17.

Referring to FIG. 3*b*, there is shown the present invention mounting support 10 directing the box fan 12 to the left. To facilitate the left direction adjustment, the receptacle member 32 or the box fan 12 itself is manipulated in the direction of arrow 88. Such a manipulation causes the second track member 62 to move within the second arcuate slot 40 and extend beyond the front edge 42 of the base member 30. The movement in direction of arrow 88 leaves the first track member 50 relatively undisturbed within the first arcuate slot 38. The movement of the second track member 62 is compensated for within the first track member 50 by the pivotable movement of the receptacle member 32 about its point of connection with the first track member 50.

In FIG. 3*c* there is shown an application where the box fan 12 has been manipulated in the direction of both arrow 90 and arrow 92. Such an application may be desirable if the height of the open window 14 is too short to accommodate the height of the box fan 12 being held by the mounting support 10. As can be seen from FIG. 3*c*, by moving the box fan 12 so that both the first track member 50 and the second track member 62 extend beyond the front edge 42 of the base member 30, the box fan 12 can be positioned beyond the confines of the window sill 16, while still being supported by the window sill 16. Once in this extended position, the box fan 12 can then be directed to the left or the right by manipulating either the left or right half of the receptacle member 32 back toward the window sill 16.

Referring to FIG. 4 an alternate embodiment of the present invention mounting support 100 is shown in an exploded fashion to best illustrate the base member 102, receptacle member 104 and the means for adjustable support between both components. As with the previously described embodiment, the base member 102 is affixed to the window sill 16 utilizing any known attachment means such as mechanical fasteners and/or clamping devices. Similarly, the receptacle member 104 is formed to retain the base of a box fan 12 in a set position, as will later be explained in detail.

The relative motion between the base member 102 and the receptacle member 104 is facilitated by a single track and groove assembly. On the top surface 105 of the base member 102, opposite its surface of contact with the window sill 16 is formed an arcuate slot 106 having a constant radius of curvature. The arcuate slot 106 begins and ends on the front edge 108 of the base member 102. In the shown embodiment, the arcuate slot 106 has a T-shaped profile, however it should be understood that other profiles, such as an L-shape or J-shape, may also be used. Two stopping tabs 114, 116 extend upwardly within the arcuate slot 106 proximate both points where the arcuate slot 106 intersects the front edge 108 of the base member 102.

A track member 110 is formed on the bottom surface 112 of the receptacle member 104. The track member 110 follows the same arcuate pattern as does the arcuate slot 106 and is sized and shaped to slidably fit within the arcuate slot 106. As such, it should be understood that the track member 110 will have a profile that matches the profile given the arcuate slot. The shapes allotted the profiles of the arcuate slot 106 and the track member 110 should be one that readily allows for the track member 110 to slide in the horizontal plane within the arcuate slot 106, yet prohibits the vertical movement of the track member 110 within the arcuate slot. On the bottom surface 118 of the track member 110 is formed a small relief 120. The relief 120 follows the arcuate path of the track member 110 but does not extend fully across the length of the track member 110. Rather the relief 120 abruptly ends at the central point halfway between the first end 122 of the track member 110 and the second end 124 of the track member 110. The area where the relief 120 ends acts as a stop that can engage the stopping tabs 114, 116 within the arcuate slot 106 thereby limiting the movement of the track member 110 within the arcuate slot 106.

Figure 5A:
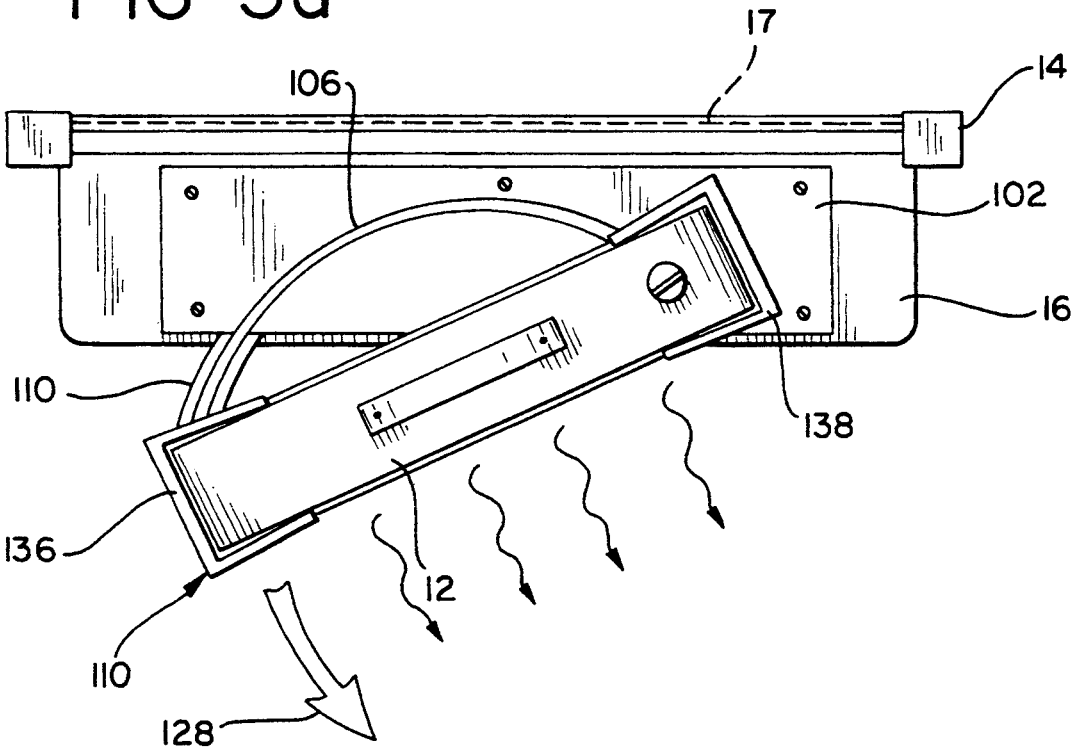
Figure 5B:
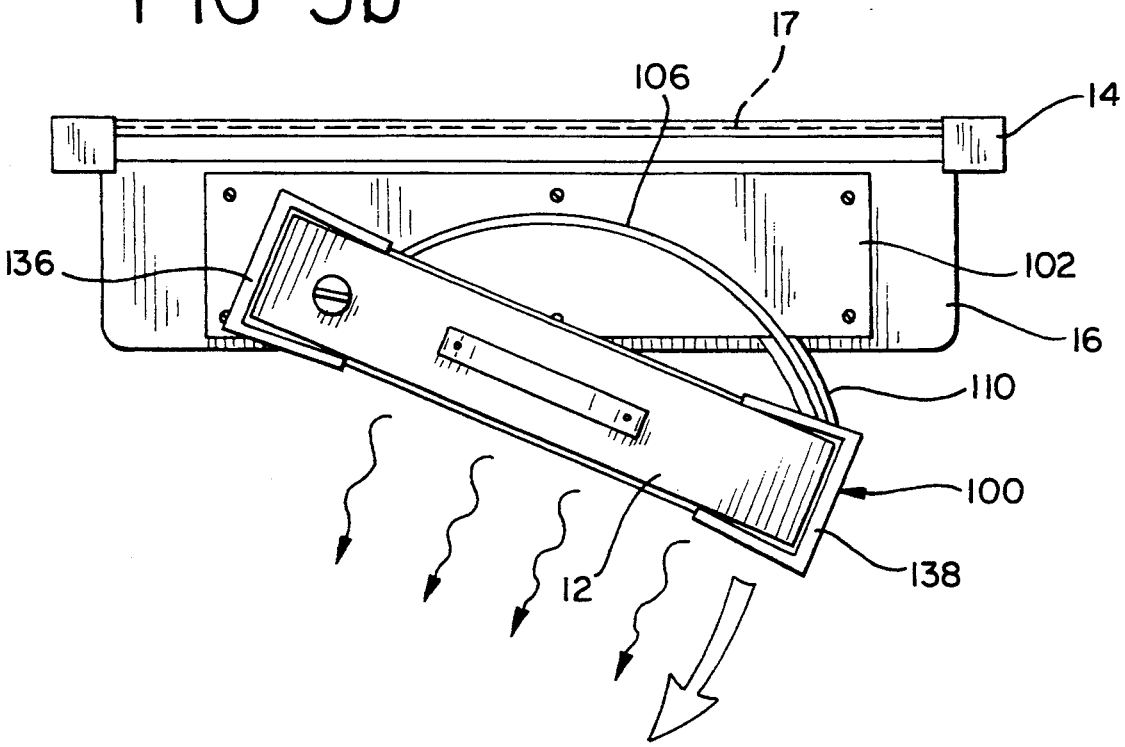

Referring now to FIGS. 5*a* and 5*b* in conjunction with FIG. 4, the pivoting function between the receptacle member 104 and the base member 102 can be explained. In FIGS. 5*a* and 5*b*, the present invention support member 100 is shown from above, as it would appear holding a box fan 12 in front of an open window 14. As can be seen in FIGS. 5*a* and 5*b*, the base member 102 of the mounting support 100 is affixed to a window sill 16 in front of an open window 14 that includes a screen 17.

The positioning of the track member 110 within the arcuate slot 106 controls the movement of the receptacle member 32 relative the base member 102. As can be seen in FIG. 5*a*, the base member 102 is affixed to the window sill 16 and the receptacle member 104 is manipulated in the direction of arrow 128 to an extreme left position. At this left position, the end of the relief 120 on the track member 110 contacts the stopping tab 114 positioned at one end of the arcuate slot 106. The contact with the stopping tab 114 prevents the receptacle member 104 from being inadvertently detached from base member 102 in the left direction.

In FIG. 5*b*, the receptacle member 104 is manipulated in the direction of arrow 130 to achieve an extreme right orientation. At this right position, the end of the relief 120 on the track member 110 contacts the stopping tab 116 positioned at one end of the arcuate slot 106. The contact with the stopping tab 116 prevents the receptacle member 104 from being inadvertently detached from the base member 102 in the right direction. As can be seen from both FIGS. 5*a* and 5*b*, the movement of the track member 110 in the arcuate slot 106 allows a supported box fan 12 to be directed to the left or to the right on a window sill 16, without compromising the integrity of the fan's support and without being limited by the presence of a window screen 17.

Returning now to FIG. 2, the first embodiment for retaining a box fan 12 within the receptacle member 32 can now be described. As can be seen from FIG. 2, the vertical sections 78, 80 and the horizontal base section 82 comprising the receptacle member 32 have U-shaped cross-sectional profiles. As such, the receptacle member 32 can be formed to conform to the base of a box fan 12 by supporting the bottom surface of the box fan 12 and the bottom regions of the box fan's two vertical framing members. In the preferred embodiment, the two vertical sections 78, 80 and the connecting horizontal base section 82 are formed of plastic and are shaped so that the free ends in their U-shaped construction slightly converge. As such, the U-shaped construction creates a slight pinching action on the box fan 12 as the box fan 12 is placed within the receptacle member 32. The pinching action is caused by the box fan's slight deformation of the U-shaped construction of the two vertical sections 78, 80 and the connecting horizontal base section 82 when the box fan 12 is positioned within the receptacle member 32. The spring bias caused by the deformation of the U-shaped construction thereby acts to positively engage and hold the box fan 12 into one set position relative the receptacle member 32.

As will be recognized by a person knowledgeable with the scope of the art, box fans come in many differing sizes. Consequently it is desirable to have a mounting support 10 that is capable of being adjusted to match the various sized fan constructions. Returning to FIG. 4, such an adjustable construction is shown. In FIG. 4 the receptacle member 104 is comprised of a base platform 134 on which are positioned two corner support brackets 136, 138. As can be seen, the width W2 of the interior of both corner support brackets 136, 138 is adjustable by the movement of one half of each corner support bracket 136, 138 relative its opposing half. Desired set positions are maintained by the use of wing nuts 142, 144, respectively. As such, it should be understood that the width W2 of each corner support bracket 136, 138 can be adjusted to match the width of the base of any box fan within a given range. It should also be understood that there exist many known technologies capable of being adapted to the corner support brackets 136, 138, that are capable of being used to vary the width W2 of the corner support brackets 136, 138. Consequently, it should be understood that the use of wing nuts 142, 144 as illustrated is merely exemplary and any other known adjustment means may be used.

In the embodiment of the receptacle member 104 expressed by FIG. 4, the distance D2 between the two corner support brackets 136, 138 is also selectively adjustable. Although the adjustment in the distance D2 can be accomplished in any known manner, the exemplified method illustrated uses a peg and hole adjustment arrangement. In the exemplary embodiment shown, a plurality of holes 146 are formed within the base platform 134. Pegs 148 are formed on the bottom of one or both of the corner support brackets 136, 138. By placing the pegs 148 of the corner support brackets 136, 138 into differing holes 146 the distance D2 between both corner support brackets 136, 138 can be selectively varied. Many technologies are known that can be used to selectively adjust the distance D2 between the two corner support brackets 136, 138. For instance, both can be mounted on slidable tracks that have selective locking mechanisms. Consequently, it should be understood that the use of holes and pegs merely represents a cost effective way to adjust the two corner support brackets 136, 138 and any other known adjustment means may be used.

Although the described embodiments of the present invention mounting support are believed to represent the best mode of the present invention, it should be understood that many described components of the present invention have many known functional equivalents. More particularly, it should be understood that there exist many ways by which the size adjustments and pivoting movement of the present invention can be constructed, other than has been specifically illustrated and described. All such variations and modifications are therefore intended to be covered by the scope of the invention as set forth in the appended claims.

What is claimed is:

1. A device for mounting a free-standing box fan on a window sill which generally extends at a normal to the vertical plane of a window, comprising:

a base member removably mountable to the window sill, said base member having at least one slot disposed therein that is curved and follows a predetermined radius of curvature;

a receptacle means for receiving and retaining a portion of said box fan therein;

at least one track member coupled to said receptacle means, wherein said at least one track member is curved and engages said at least one slot in said base member and is slidably movable within said at least one slot across a path that follows said radius of curvature, wherein the movement of said at least one track member in said at least one slot varies the orientation of said receptacle means in relation to said base member, thereby enabling a box fan being retained within the receptacle means to be directed into a desired position relative the plane of said window without extending beyond the plane of said window.

2. The device according to claim 1, wherein said receptacle means includes an adjustment means, whereby said receptacle means can be selectively adjusted in size to receive and retain a box fan of a desired size.

3. The device according to claim 1, wherein said receptacle means includes a spring bias engagement means for positively engaging and retaining said portion of said box fan when said portion of said box fan is positioned within said receptacle means.

4. The device according to claim 1, wherein said receptacle means is adapted to receive a box fan that has a base surface with an opposing first and second end, whereby said receptacle means includes a first region that receives and retains the first end of the box fan and a second region that receives and retains the second end of the box fan, said first region and said second region of said receptacle means being independently positionable relative said base member, thereby enabling the first and second end of the box fan to be moved independently relative the plane of the window.

5. The device according to claim 1, wherein said at least one track member is slidably movable within said at least one slot in a plane generally perpendicular to the plane of the window, whereby said receptacle means moves with said at least one track member in said plane generally perpendicular to the plane of the window.

6. The device according to claim 5, wherein said at least one slot has a constant radius of curvature within said base member and said at least one track member is shaped to fit within said at least one slot thereby enabling said receptacle means to be moved relative said base member across a path that follows said radius of curvature.

7. The device according to claim 1, wherein said at least one slot includes a stopping means for stopping said at least one track member from inadvertently disengaging said at least one slot.

8. The device according to claim 1, wherein said at least one slot includes a first arcuate slot and a second arcuate slot formed within said base member and said at least one track member includes a first and second track member formed to slidably engage said first slot and said second slot respectively, said first track member being affixed to a first region of said receptacle means at a pivotable point and said second track member being affixed to a second region of said receptacle means at a pivotable point, wherein said first region of said receptacle means can be independently repositioned relative said base member by slidably moving said first track member within said first arcuate slot and said second region of said receptacle means can be independently repositioned relative said base member by slidably moving said second track member within said second track member.

9. A device for mounting a box fan on a narrow window sill adjacent a window screen, wherein the box fan has a base surface with an opposing first and second end, said device comprising;

a base removably attachable to the window sill;

a receptacle means, having a first region and a second region wherein, said first region of said receptacle means receives and retains the first end of the box fan and said second region of said receptacle means receives and retains the second region of the box fan;

a first extendable member coupled between said base and said first region of said receptacle means, wherein said first extendable member is pivotably coupled to said receptacle means, said first extendable member supporting said first region of said receptacle means at a first predetermined position relative to said base, wherein said first predetermined position can be selectively varied by the movement of said first extendable member relative to the base; and a second extendable member coupled between said base aria said second region of said receptacle means, wherein said second extendable member is pivotably coupled to said receptacle means, said second extendable member supporting said second region of said receptacle means at a second predetermined position relative to said base, wherein said second predetermined position can be selectively varied by the movement of said second extendable member relative to the base;

wherein, said first region and said second region of said receptacle means are independently positionable relative said base member, thereby enabling the first and second end of the box fan to be moved independently relative to the window screen;

and wherein said base includes a first slot and a second slot disposed therein, wherein said first extendable member includes a first track member that engages said first slot in said base and said second extendable member includes a second track member that engages said second slot in said base, whereby said receptacle means is moved relative said base by the movement of said first track member and said second track member within said first slot and second slot, respectively.

10. The device according to claim 9, wherein said receptacle means includes an adjustment means, whereby said receptacle means can be selectively adjusted in size to receive and retain said box fan therein.

11. The device according to claim 9, wherein said base is mountable upon a window sill that extends from a forward edge backward to the window screen, wherein said first extendable member and said second extendable member are capable of respectively supporting said first region and said second region of said receptacle means beyond the forward edge of the window sill.

12. The device according to claim 9, wherein said first slot and said second slot is arcuate in shape having a constant radius of curvature.

13. The device according to claim 12, wherein said first slot and said second slot include stopping means for stopping said first track member and said second track member, respectively, from inadvertently disengaging said first slot and said second slot.

14. The device according to claim 13, wherein said first track member is affixed to said first region of said receptacle means at a pivotable point and said second track member being affixed to said second region of said receptacle means at a pivotable point, wherein said first region of said receptacle means can be independently repositioned relative said base by slidably moving said first track member within said first slot and said second region of said receptacle means can be independently repositioned relative said base by slidably moving said second track member within said second slot.

15. A device for mounting a fan on a window sill, comprising:

a base member selectively mountable to the window sill, said base member having an arcuate slot of a predetermined radius of curvature disposed therein;

a receptacle means having a first region and a second region for receiving and retaining the fan;

an arcuate track member having a first end and a second end, wherein said first end of said track member is coupled to said first region of said receptacle means and said second end of said track member is coupled to said second region of said receptacle means, wherein said track member passes through said slot in said base member and is slidably movable therein, thereby joining said receptacle means to said base member.

* * * * *